United States Patent [19]

Kirshman

[11] 4,419,076

[45] Dec. 6, 1983

[54] WAFER TRAY CONSTRUCTION

[75] Inventor: Samson Kirshman, San Jose, Calif.

[73] Assignee: Applied Materials, Inc., Santa Clara, Calif.

[21] Appl. No.: 343,587

[22] Filed: Jan. 28, 1982

[51] Int. Cl.[3] ..... F27D 5/00

[52] U.S. Cl. ..... 432/253; 373/18; 432/258

[58] Field of Search ..... 373/18; 220/23.83; 432/258, 253; 248/131, 132; 312/126, 283, 285

[56] References Cited

U.S. PATENT DOCUMENTS 1,029,709 6/1912 Norrlander ..... 312/285

2,297,286 9/1942 Book ..... 432/258

3,475,070 10/1969 Hoshall ..... 312/283

*Primary Examiner*—John J. Camby

*Attorney, Agent, or Firm*—Flehr, Hohbach, Test, Albritton & Herbert

[57] ABSTRACT

Wafer tray construction for use in a gas plasma reactor. A plurality of the trays are arranged in an array, with an overlap at the adjacent edges of the trays to prevent line-of-sight communication between the trays and ion bombardment of the support on which the trays are mounted. In one disclosed embodiment, the edges of the trays are configured to form the overlap, and in a second embodiment bars inserted between the trays cooperate with the edge portions to form the overlap.

13 Claims, 3 Drawing Figures

WAFER TRAY CONSTRUCTION

This invention pertains generally to apparatus for processing wafers in a gas plasma reactor and more particularly to the construction of a tray for holding wafers in the reactor chamber.

Wafers to be processed in a plasma reactor are commonly placed on one or more trays which are placed on a target or other suitable support in the reactor chamber. In order to prevent ion bombardment of the support, and hence undesired sputtering and contamination, there have been some attempts to cover exposed portions of the support with tape or other shielding. Some of these attempts have been cumbersome and makeshift in nature, and they have not always provided the desired degree of protection.

It is in general an object of this invention to provide a new and improved wafer tray construction for use in a plasma reactor.

Another object of the invention is to provide a wafer tray construction of the above character which serves to prevent ion bombardment of the structure on which the trays are placed in the reactor chamber.

Another object of the invention is to provide a wafer tray construction of the above character which permits a plurality of similar trays to be used interchangeably in an array.

Another object of the invention is to provide a wafer tray construction of the above character which permits individual trays to be mounted on and removed from the support structure in a random order without disturbing other trays on the support.

These and other objects are achieved in accordance with the invention by providing wafer trays with a novel edge configuration which prevents line-of-sight communication between the edge portions of adjacent ones of the trays mounted on a support structure in a reactor chamber. In one disclosed embodiment, each of the edge portions has two obliquely disposed surfaces which overlap in a mating relationship to prevent ion bombardment of the support structure, and in another embodiment bars inserted between the edges of adjacent trays cooperate with the contoured edges to prevent bombardment of the support structure. All of the trays are similar in construction, and they can be used interchangeably in an array on the support. In addition, the edge configuration permits individual trays to be installed and removed in a random order without disturbing other trays in the array.

Figure 1:
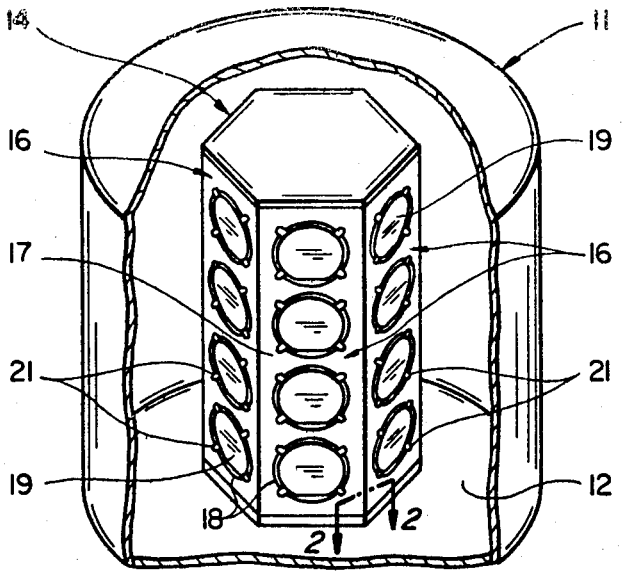
FIG. 1 is a fragmentary isometric view of one embodiment of a plasma reactor in which the wafer tray construction of the invention is employed.

In FIG. 1, the invention is illustrated in connection with a plasma reactor 11 having a reactor chamber 12 in which an ionized gas plasma is formed by conventional means to effect a desired process, e.g., etching or deposition. A multifaceted support structure 14 is positioned centrally within the reactor chamber, and a plurality of wafer trays 16 are removably mounted on the support structure. In the embodiment illustrated, the support structure has six faces or sides, and the wafer trays are arranged in a hexagonal array on the support. However, it will be understood that the support structure can have any suitable number of sides and that any convenient number of trays can be employed. The support structure is fabricated of a rigid, electrically conductive material such as aluminum, and the trays are releasably secured to the support by clips (not shown).

Each of the wafer trays 16 comprises a rectangular, generally planar body 17 having a plurality of wafer receiving openings 18 formed therein. Wafers 19 are releasably secured in the openings by clips 21 which engage the edge portions of the wafers. Each of the trays is identical, and the trays can be used interchangeably and mounted in different positions on the support structure. The trays are fabricated of a rigid, electrically conductive material such as aluminum.

Figure 2:
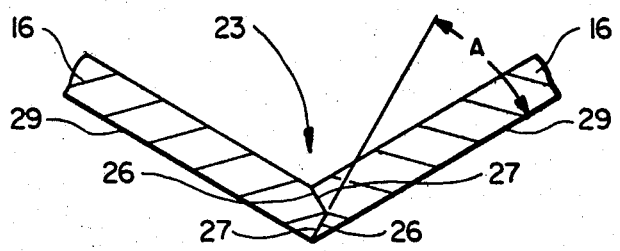
FIG. 2 is an enlarged fragmentary sectional view taken along line 2—2 in FIG. 1, illustrating one embodiment of the invention.

An overlap 23 is provided at the adjacent edges of the trays on the support structure to prevent line-of-sight communication with the support structure, and, hence, undesired ion bombardment of that structure. In the embodiment of FIG. 2, the overlap is provided by a pair of obliquely disposed mating surfaces 26, 27 which extend along the opposing side edges of the trays. Surfaces 26 are generally perpendicular to the major surfaces 29 of the trays on which they are formed, and surfaces 27 are generally perpendicular to the major surfaces of the adjacent trays in the array.

In the embodiment illustrated wherein six trays are employed in the array, surfaces 27 are inclined at an angle A of 30° with respect to the major surfaces of the trays on which they are formed. With a different number of trays, angle A is given by the relationship $$A=90-(360/n)$$

where A is in degrees and n is the number of trays in the array.

Surfaces 26 and 27 occupy reciprocal positions on the opposing edges of each tray so that the adjacent edges of two similar trays will mate together to provide the proper overlap when the trays are placed side-by-side in the desired array on the support structure. In other words, on one edge, surface 26 is adjacent to the front of the tray and surface 27 is adjacent to the rear, and on the other edge, surface 26 is adjacent to the rear and surface 27 is adjacent to the front.

In addition to preventing direct ion bombardment of the support structure, the edge construction of FIG. 2 permits individual trays to be mounted on and removed from the support structure at random without lateral movement of the trays and without disturbing the other trays in the array.

Figure 3:
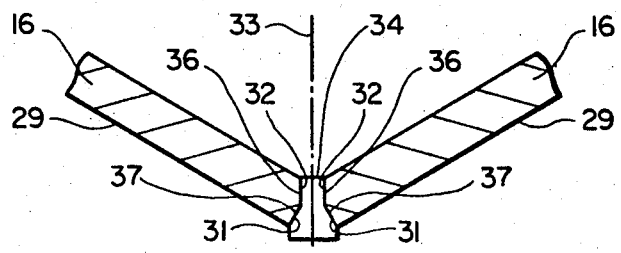
FIG. 3 is an enlarged fragmentary sectional view similar to FIG. 2, illustrating a second embodiment of the invention.

In the embodiment of FIG. 3, each of the adjacent edges of the trays has an outer surface 31 which is generally perpendicular to the major surface of the tray and an inner surface 32 which is generally parallel to a radial plane 33 passing through the line of intersection of two adjacent trays in the array. A bar 34 of generally T-shaped cross section is removably mounted between the edges of the trays and provided with generally parallel surfaces 36 and outwardly diverging surfaces 37 which face surfaces 32, 31, respectively, on the tray edges. Bars 34 cooperate with surfaces 31, 32 to form an overlap which prevents line-of-sight communication with the support structure, as do edge surfaces 26, 27 in the embodiment of FIG. 2. With the bars removed individual trays can be placed directly onto and removed from the support structure without disturbing the other trays in the array.

The invention has a number of important features and advantages. It eliminates line-of-sight communication between adjacent wafer trays and prevents ion bombardment of the tray support without the need of cumbersome shielding. The trays can be installed in an array and removed therefrom on an individual basis and in any order without disturbing the other trays in the array. Being identical, the trays can be used interchangeably and located in any desired position in the array.

It is apparent from the foregoing that a new and improved wafer tray construction has been provided. While only certain presently preferred embodiments have been described in detail, as will be apparent to those familiar with the art, certain changes and modifications can be made without departing from the scope of the invention as defined by the following claims.

I claim:

1. In apparatus for processing wafers in a plasma reactor having a chamber in which a gas plasma is formed and a support for holding trays of wafers to be processed in the chamber: an array of wafer holding trays mounted on the support with an overlap at the adjacent edges of the trays preventing line-of-sight communication between the trays and permitting individual ones of the trays to be removed from the support at random without disturbing the remaining trays in the array.

2. The apparatus of claim 1 wherein the adjacent edges of the trays mate together to form the overlap.

3. The apparatus of claim 2 wherein the adjacent trays in the array are positioned obliquely to each other, and the mating edge of each tray has two obliquely disposed surfaces, one of said surfaces being generally perpendicular to the surface of the tray and the other of said surfaces being generally perpendicular to the surface of the adjacent tray.

4. The apparatus of claim 1 wherein elongated bars are positioned between the adjacent edges of the trays and formed with surfaces which cooperate with the edges of the trays to form the overlap.

5. The apparatus of claim 4 wherein the adjacent trays in the array are positioned obliquely to each other, and each of the bars has a pair of generally parallel surfaces in facing proximity to corresponding surfaces on the edges of the trays and a pair of surfaces which diverge from the generally parallel surfaces and face corresponding surfaces on the edges of the trays.

6. The apparatus of claim 5 wherein the diverging surfaces of the bars are generally perpendicular to the major surfaces of the respective trays.

7. In apparatus for processing wafers in a plasma reactor; a generally planar tray having a pair of oppositely disposed edge portions, each of said edge portions having first and second obliquely disposed mating surfaces extending along the full extent thereof, the surfaces on the two edge portions occupying reciprocal positions whereby the surfaces on one edge of the tray mate with the surfaces on the other edge of a second tray positioned adjacent to the first named tray, thereby preventing line-of-sight communication between the adjacent edge portions of the trays.

8. The apparatus of claim 7 wherein one of the surfaces along each of the edge portions of the trays is generally perpendicular to the surface of the tray.

9. In apparatus for processing wafers: a reaction chamber in which an ionized gas plasma is formed, a supporting structure having a plurality of angularly displaced faces positioned centrally within the reaction chamber, a plurality of generally planar wafer supporting trays mounted on the faces of the support structure, and means at the confronting edges of adjacent ones of said trays preventing line-of-sight communication between the trays to the support structure.

10. The apparatus of claim 9 wherein the confronting edges of adjacent ones of the trays mate together in overlapping fashion.

11. The apparatus of claim 10 wherein each of the confronting edges has two obliquely disposed surfaces, one of said surfaces being generally perpendicular to the major surface of the tray, and the other of said surfaces being generally perpendicular to the major surface of the adjacent tray.

12. The apparatus of claim 9 wherein elongated bars are removably mounted between the confronting edges of adjacent trays and formed with surfaces which mate with the confronting edges of the trays to prevent line-of-sight communication between the confronting edges.

13. The apparatus of claim 12 wherein each of the bars has a pair of generally parallel surfaces and a pair of surfaces which diverge from the generally parallel surfaces in directions generally perpendicular to the major surfaces of the adjacent trays.

* * * * *